US008375708B2

(12) United States Patent
Forster et al.

(10) Patent No.: US 8,375,708 B2
(45) Date of Patent: Feb. 19, 2013

(54) STATIC MIXING ELEMENT AND METHOD OF PRODUCING A STATIC MIXING ELEMENT

(75) Inventors: Erich Forster, Grossaitingen (DE); Rolf Kaiser, Augsburg (DE); Klaus Regenold, Friedberg (DE); Klaus Rusch, Achberg (DE)

(73) Assignee: Emcon Technologies Germany (Augsburg) GmbH, Augsburg (DE)

( * ) Notice: Subject to any disclaimer, the term of this patent is extended or adjusted under 35 U.S.C. 154(b) by 406 days.

(21) Appl. No.: 12/528,868

(22) PCT Filed: Feb. 25, 2008

(86) PCT No.: PCT/EP2008/001478

§ 371 (c)(1),
(2), (4) Date: Mar. 5, 2010

(87) PCT Pub. No.: WO2008/104350

PCT Pub. Date: Sep. 4, 2008

(65) Prior Publication Data

US 2010/0218490 A1 Sep. 2, 2010

(30) Foreign Application Priority Data

Feb. 28, 2007 (DE) ..... 10 2007 009 890

(51) Int. Cl.
*F01N 1/00* (2006.01)
*F01N 3/02* (2006.01)

(52) U.S. Cl. ..... 60/324; 60/317

(58) Field of Classification Search ..... 60/286, 60/295, 303, 317, 324
See application file for complete search history.

(56) References Cited

U.S. PATENT DOCUMENTS

| | | | | |
|---|---|---|---|---|
| 1,345,791 | A * | 7/1920 | Livingstone | 48/189.4 |
| 4,719,090 | A * | 1/1988 | Masaki | 422/310 |
| 5,378,063 | A * | 1/1995 | Tsukada | 366/337 |
| 5,916,134 | A * | 6/1999 | Yang et al. | 60/299 |
| 6,467,949 | B1 * | 10/2002 | Reeder et al. | 366/338 |
| 6,539,420 | B1 * | 3/2003 | Fields et al. | 709/206 |
| 6,553,755 | B2 * | 4/2003 | Hofmann et al. | 60/282 |

(Continued)

FOREIGN PATENT DOCUMENTS

| | | |
|---|---|---|
| DE | 2522106 | 11/1976 |
| EP | 154591 | 3/2005 |

(Continued)

OTHER PUBLICATIONS

Search Report and Written Opinion.

(Continued)

*Primary Examiner* — Kenneth Bomberg
*Assistant Examiner* — Dapinder Singh
(74) *Attorney, Agent, or Firm* — Carlson, Gaskey & Olds, PC

(57) ABSTRACT

A static mixing element, in particular for arrangement in an exhaust system of an internal combustion engine, has a grid-like component having a flow therethrough. The grid-like component is formed in one piece from an elongated metal strip. In the production of the static mixing element, the metal strip is bent to form the grid-like component.

26 Claims, 3 Drawing Sheets

U.S. PATENT DOCUMENTS

| | | | | |
|---|---|---|---|---|
| 6,837,213 | B1 * | 1/2005 | Burnett | 123/306 |
| 7,267,098 | B1 * | 9/2007 | Tasanont | 123/306 |
| 7,533,520 | B2 * | 5/2009 | Cheng et al. | 60/286 |
| 7,784,273 | B2 * | 8/2010 | Kanaya et al. | 60/286 |
| 7,793,494 | B2 * | 9/2010 | Wirth et al. | 60/324 |
| 7,805,932 | B2 * | 10/2010 | Oxborrow | 60/324 |
| 7,908,845 | B2 * | 3/2011 | Brown et al. | 60/286 |
| 2002/0110047 | A1 | 8/2002 | Bruck et al. | |
| 2003/0165080 | A1 * | 9/2003 | Pinyayev et al. | 366/337 |
| 2007/0204751 | A1 * | 9/2007 | Wirth et al. | 96/290 |

FOREIGN PATENT DOCUMENTS

| | | |
|---|---|---|
| EP | 1712751 | 10/2006 |
| WO | 0112960 | 2/2001 |

OTHER PUBLICATIONS

International Preliminary Report on Patentability dated Sep. 8, 2009.

* cited by examiner

STATIC MIXING ELEMENT AND METHOD OF PRODUCING A STATIC MIXING ELEMENT

RELATED APPLICATION

This application is the U.S. national phase of PCT/EP2008/001478, which was filed Feb. 25, 2008, which claimed priority to German application DE 10 2007 009 890.3, which was filed Feb. 28, 2007.

FIELD OF THE INVENTION

The present invention relates to a static mixing element, in particular for arrangement in an exhaust system of an internal combustion engine, including a grid-like component having a flow therethrough. The invention further relates to a method of producing a static mixing element including a grid-like component having a flow therethrough.

BACKGROUND OF THE INVENTION

A generic mixing element is disclosed, e.g., in EP 1 712 751 A2 and serves to distribute, as homogeneously as possible, a liquid introduced into a conduit in a gas stream flowing through the conduit. In particular, the mixing element is used to mix an exhaust gas stream containing nitrogen oxide with an aqueous urea solution. In a $DeNO_x$ catalytic converter connected downstream, the nitrogen oxides and the ammonia, obtained from urea by hydrolysis, are catalytically converted into water and nitrogen according to the method of selective catalytic reduction. In known mixing elements, the grid-like components are assembled from a large number of individual parts which are subsequently connected with each other, for example by laser welding or gas shielded arc welding. Therefore, known mixing elements are comparatively involved and thus expensive to produce.

SUMMARY OF THE INVENTION

The invention provides a mixing element and a method of producing a mixing element, which, compared with the prior art, is simpler and, hence, more cost-effective.

According to a first aspect of the invention, in a static mixing element of the kind previously mentioned, this is achieved by forming a component of the mixing element in one piece from an elongated metal strip. This configuration allows the numerous welded joints, which are required between the individual parts in known mixing elements, to be eliminated, and the mixing element may be produced in an automated manufacturing process. In this way, the production costs can be distinctly lowered compared with the prior art. In addition, the static mixing element according to the invention distinguishes itself by an increased stability and durability. In particular, the gas stream is not only diverted, but (in the region of the component) also split up by the grid-like component, which is not limited to conventional grid shapes having a plurality of parallel or intersecting webs.

Preferably, the component is formed by bending, which results in an especially simple production.

According to a first embodiment, the metal strip includes a first section which is bent to form a plurality of substantially parallel loops which more particularly are arranged side by side.

In one preferred example, partial portions, substantially parallel to each other, of the loops form a plurality of first webs of the grid-like component, whereby the basic shape thereof is already obtained.

The loops are more particularly open and U-shaped and continue directly into one another.

The metal strip may include a second section which forms one or a plurality of second webs intersecting the first webs of the grid-like component. The second section is more particularly arranged perpendicularly to the first webs and increases the stability of the component.

To facilitate insertion of the mixing element into a conduit, in particular an exhaust pipe, the metal strip may include a third section which forms a frame that at least partly surrounds the component.

The loops advantageously include bent portions that rest against the frame, which results in a high stability of the mixing element.

Preferably, the first section is a middle section and the second and third sections are edge sections of the metal strip. Such an arrangement of the sections facilitates the production of the mixing element. As an alternative, however, different arrangements of the sections relative to each other are also conceivable.

For example, the third section, which forms the frame, may be a middle section, while the first and second sections are configured as edge sections of the metal strip.

According to an alternative embodiment, the metal strip includes a first section which is bent to form a spiral or a ring and, in this configuration, forms both part of the grid-like component and a frame surrounding it.

To increase the dimensional stability of the mixing element, in this embodiment, too, the metal strip may include a second section which is bent to form a web intersecting the spiral/the ring.

In order to attain a particularly high stability of the static mixing element, the second section preferably includes a plurality of slits fitted into corresponding slits of the first section to form points of intersection.

According to one preferred example of the invention, provision is made for a plurality of deflector elements which project from the component and are inclined in relation to the grid plane normal; in this connection, grid plane normal should be understood to mean the normal to the principal plane of the grid-like component. The deflector elements produce swirls which result in a better mixing of the two media.

The deflector elements are more particularly formed in one piece with the metal strip. This also makes it possible to eliminate previously required welded or soldered joints.

The deflector elements are arranged, e.g., in a plurality of rows that are parallel to each other, all of the deflector elements of one row being inclined in the same direction. In this way, an especially uniform distribution of a liquid medium in a gas stream is achieved.

Advantageously, the deflector elements of at least two directly adjacent middle rows are inclined in the same direction. This additionally facilitates the production of the mixing element because when bending closely adjacent deflector elements, it is easier if neighboring deflector elements can be bent in the same direction.

The deflector elements of the rows that are adjacent to the middle rows are preferably inclined in the opposite direction to those of the middle rows. This results in opposite directions of deflection of the flowing medium in a middle region and in adjacent edge regions, which leads to a particularly good mixing.

Other preferred designs of the mixing element provide for a position of the deflector elements by which a swirling flow or eddies in opposite directions are produced. More particularly, provision may also be made for deflector elements on the frame of the mixing element, which generate turbulences in the edge region.

According to a second aspect of the invention, provision is made for a method of producing a static mixing element of the kind mentioned at the outset, which includes the step of providing an elongated metal strip and bending the metal strip to form the grid-like component.

The method according to the invention is particularly simple and, hence, cost-effective and, in addition, allows the production process to be automated. Welded joints between the individual parts of the component may be largely eliminated. In addition, the static mixing element produced the method according to the invention distinguishes itself by a high stability.

According to a first variant of the method, the component includes a plurality of first webs and at least one second web arranged perpendicularly thereto, a first section of the metal strip being bent to form a plurality of substantially parallel loops, the parallel partial portions of which form the first webs, a second section of the metal strip being bent to form the second web, and the second web being fitted onto the first webs. The method steps are preferably carried out in the order as specified, but this is not absolutely necessary. For example, the second web could be bent before the first webs. Alternatively, it is conceivable to dispense with the second web altogether.

In an alternative variant of the method, a first section of the metal strip is bent to form a spiral or a ring, a second section of the metal strip is bent to form a web intersecting the spiral/the ring, and the second web is fitted onto the spiral. Again, a stable and cost-effective mixing element is provided in a simple manner.

According to one embodiment, a section of the metal strip is bent to form a frame which at least partly surrounds the component. The frame is more particularly adapted to the cross-section of a conduit into which the mixing element is to be inserted.

In a last method step, the component and/or the frame may be welded or soldered at some points. In this way, the stability of the mixing element is further increased. Planar connections are also conceivable here.

A plurality of deflector elements, which are inclined with respect to the grid plane normal, are integrally formed with the metal strip. The deflector elements may be stamped jointly with the metal strip, for example.

In particular, the deflector elements may be useful for locating purposes during the bending process, which is preferably carried out in a bending machine.

Furthermore, prior to bending, the metal strip may be provided with bending marks, which are utilized by a bending machine as holding or orientation points during bending.

It should be pointed out that all details such as the deflector elements, recesses or slots for plug connections, and other marks that are produced on the metal strip by stamping, laser treatment or other kinds of material-removing machining, are preferably shaped already prior to bending the metal strip to form the grid-like component.

These and other features of the present invention can be best understood from the following specification and drawings, the following of which is a brief description.

BRIEF DESCRIPTION OF THE DRAWINGS

Further features and advantages of the invention will be apparent from the following description of several preferred embodiments with reference to the accompanying drawings, in which.

DETAILED DESCRIPTION OF THE PREFERRED EMBODIMENT

Figure 1:
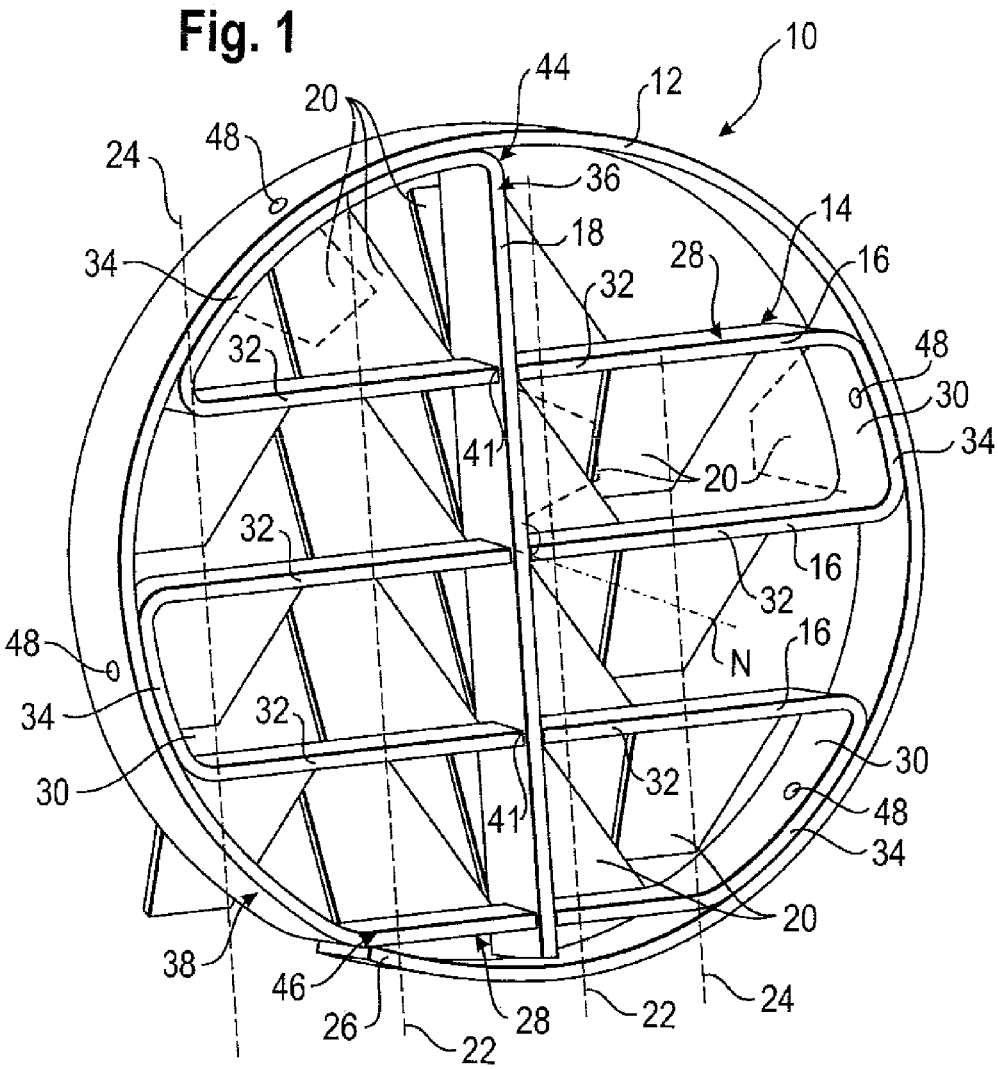
FIG. 1 shows a perspective view of a mixing element according to a first embodiment of the invention.

FIG. 1 shows a static mixing element 10 according to the invention, which includes a grid-like component 14 which is bordered by a ring-shaped frame 12 and which, in the embodiment shown, is formed by a plurality of parallel-oriented first webs 16 and a second web 18 which intersects the first webs 16 and in this case is more particularly arranged perpendicularly to the first webs 16.

Formed in one piece with the first webs 16 is a plurality of deflector elements 20, which project from the grid-like component 14 and are inclined in relation to the grid plane normal N. The deflector elements 20 are arranged in a plurality of rows 22, 24 parallel to one another, with all deflector elements 20 of one row 22, 24 being inclined in the same direction. The deflector elements 20 of the two immediately adjacent middle rows 22, which are separated from each other by the second web 18, are inclined in the same direction, whereas the deflector elements 20 of the outer rows 24, which are adjacent to the middle rows 22, are inclined in the opposite direction to the deflector elements 20 of the middle rows 22. More particularly, adjacent deflector elements 20 of the middle rows 22 are oriented parallel to each other, and all of the deflector elements 20 of one row 22, 24 have the same angle of inclination in relation to the grid plane normal N, which amounts to between 10 degrees and 60 degrees, and are preferably approximately 45 degrees. The deflector elements 20, which have a trapezoidal shape here and are in the form of stamped metal parts made without a finishing machining step after the stamping process, are inclined in the longitudinal direction of the rows and are tapered in the direction away from the component 14. The length of the deflector elements 20 substantially corresponds to the width of the rows 22, 24. As is indicated by dashed lines in FIG. 1, provision may furthermore be made for deflector elements 20 on the second web 18 and in the region of the frame 12, which, with respect to the principal plane of the grid-like component 14, may also extend in the other direction from that of the remaining deflector elements 20.

As is apparent from FIG. 1, the grid-like component 14 and the frame 12, i.e. the entire mixing element 10, are formed in one piece, more particularly bent, from one single elongated metal strip 26. The metal strip 26 here includes a central first section 28, which is bent to form a plurality of substantially parallel, open, U-shaped loops 30. The partial portions 32, parallel to each other, of the loops 30 form the first webs 16. Between the parallel partial portions 32, the loops 30 have bent portions 34 which rest against the frame 12. The metal strip 26 further includes a second section 36 which adjoins the first section 28 and forms the second web 18, and which is an edge section of the metal strip 26. A third section 38 of the metal strip 26, which is an edge section adjacent to the central first section 28 on the side opposite to the second section 36, forms the frame 12 surrounding the component 14.

Figure 2:
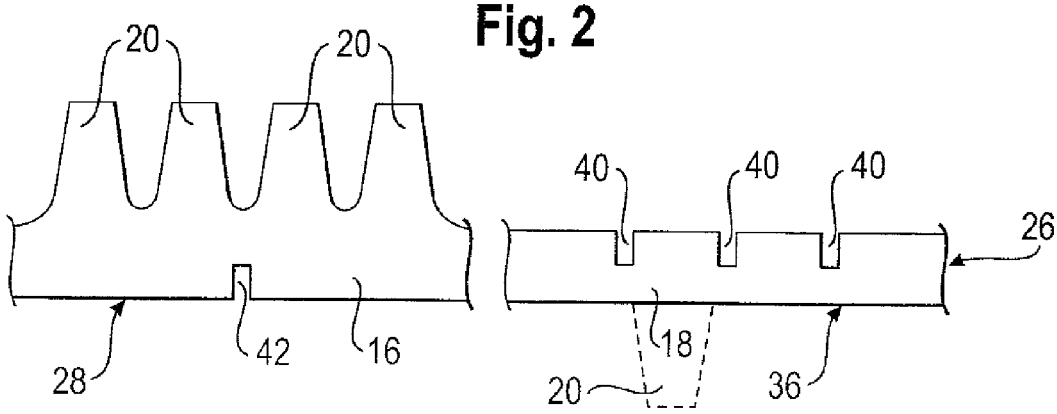
FIG. 2 shows a view of a metal strip which forms the grid-like component of the mixing element of FIG. 1.

To increase the stability of the grid-like component 14, the second section 36 includes a plurality of slits 40 fitted into corresponding slits 42 of the first section 28 to form points of intersection 41 of the grid-like component 14 (see in particular FIG. 2).

To produce the static mixing element 10, the metal strip 26 with the deflector elements 20 integrally formed in the region of the central first section 28 (and, if desired, in the region of the second section 36 and in the region of the third section 38) is provided and the first section 28 is bent to form a total of three loops 30, the parallel partial portions 32 of which form the first webs 16. Subsequently, the second section 36 is bent downward by 90 degrees at the point denoted by 44 (with respect to the illustration in FIG. 1), and the second web 18 formed in this way is fitted onto the first webs 16 in that the slits 40 of the second web 18 are placed into the slits 42 of the first webs 16. Then, starting from the point 46, the third section 38 is bent to form the circular frame 12 that surrounds the component 14. In the bending process, the deflector elements 20 already integrally formed with the metal strip 26 may be made use of for locating, for example in a bending machine. Subsequently, the components 14 and/or the frame 12 are welded or soldered selectively at the connecting points denoted by 48. In this connection, resistance welding is conceivable in particular. Finally, the deflector elements 20 integrally formed with the metal strip 26 are bent upward or downward out of their position parallel to the metal strip 26. It should be appreciated here that instead of the straight bending axes shown in FIG. 1, which are each situated in the plane of the metal strip 26, bending axes that are arranged at an angle thereto are also conceivable, that is, the deflector elements 20 are tilted along the longitudinal axis thereof in relation to the metal strip 26. It is also possible to use inherently bent deflector elements 20. The order specified above of the individual method steps is, of course, not obligatory.

Figure 3:
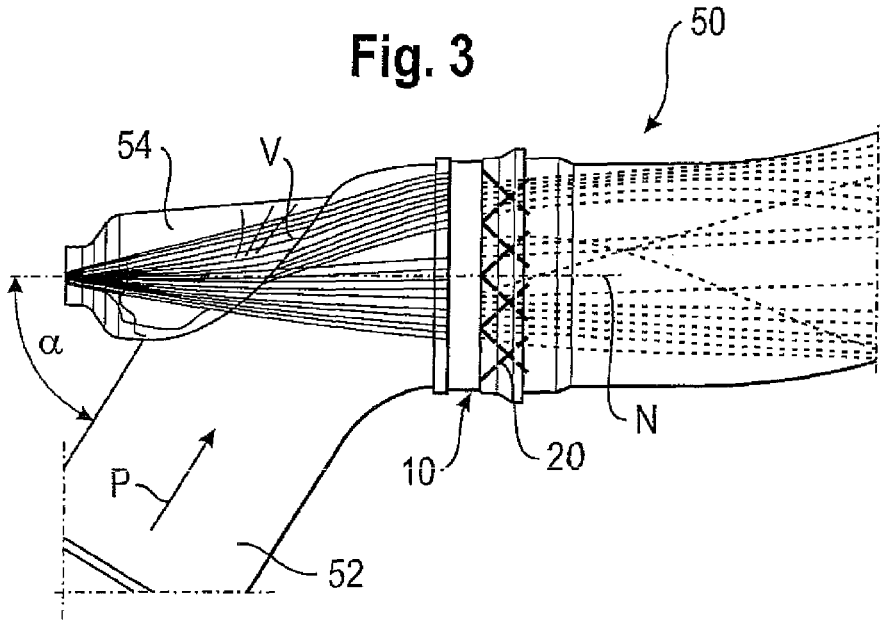
FIG. 3 shows a side view of an exhaust system with the mixing element of FIG. 1.

FIG. 3 shows some portions of an exhaust system 50 for an internal combustion engine, in particular of a motor vehicle, which includes a pipe 52 through which exhaust gas flows and a supply member 54 to supply a reducing agent, such as an aqueous urea solution. The mixing element 10 is arranged downstream of the supply member 54 with respect to the direction of flow of the exhaust gas as indicated by the arrow P, with the deflector elements 20 being positioned on a downstream side of the grid-like component 14. As already described, some deflector elements may also be additionally provided on the upstream side. The grid plane normal N coincides with the longitudinal axis of the pipe 52 on the downstream side. Downstream of the mixing element 10, provision is made for an SCR catalytic converter (not shown). As an alternative to the configuration shown, the supply means 54 may be a vaporizer for fuel which, along with the mixing element 10, is connected upstream of a particulate filter.

Upstream of the mixing element 10, that is, on the side facing away from the deflector elements 20, the pipe 52 is angled by 15 degrees to 60 degrees (angle $\alpha$), in this case by approx. 45 degrees, in relation to the grid plane normal N. As is apparent from FIG. 3, the pipe 52 is angled along the rows 22, 24, that is, the exhaust gas impinges roughly perpendicularly on the deflector elements 20, pointing downwards in the Figure, of the middle rows 22. The reducing agent, on the other hand, is supplied at an angle of between 15 degrees and 60 degrees to the inflow direction of the exhaust gas.

For the reduction of nitrogen oxides contained in the exhaust gas, in operation, an aqueous urea solution is introduced via the supply member 54 (distribution paths V), the urea solution being finely distributed and vaporized by the mixing element 10. Any drops that may be present here impinge on the deflector elements 20 and burst thereby. In order to promote the vaporization of the urea solution and the conversion into ammonia, the deflector elements 20 or the entire mixing element 10 may include a catalytically active coating (not shown). In a further preferred application, the mixing element 10 serves to mix in oxidizable substances, in particular fuel vapor, into a principal flow upstream of an oxidation or reformation catalytic converter.

Figure 4:
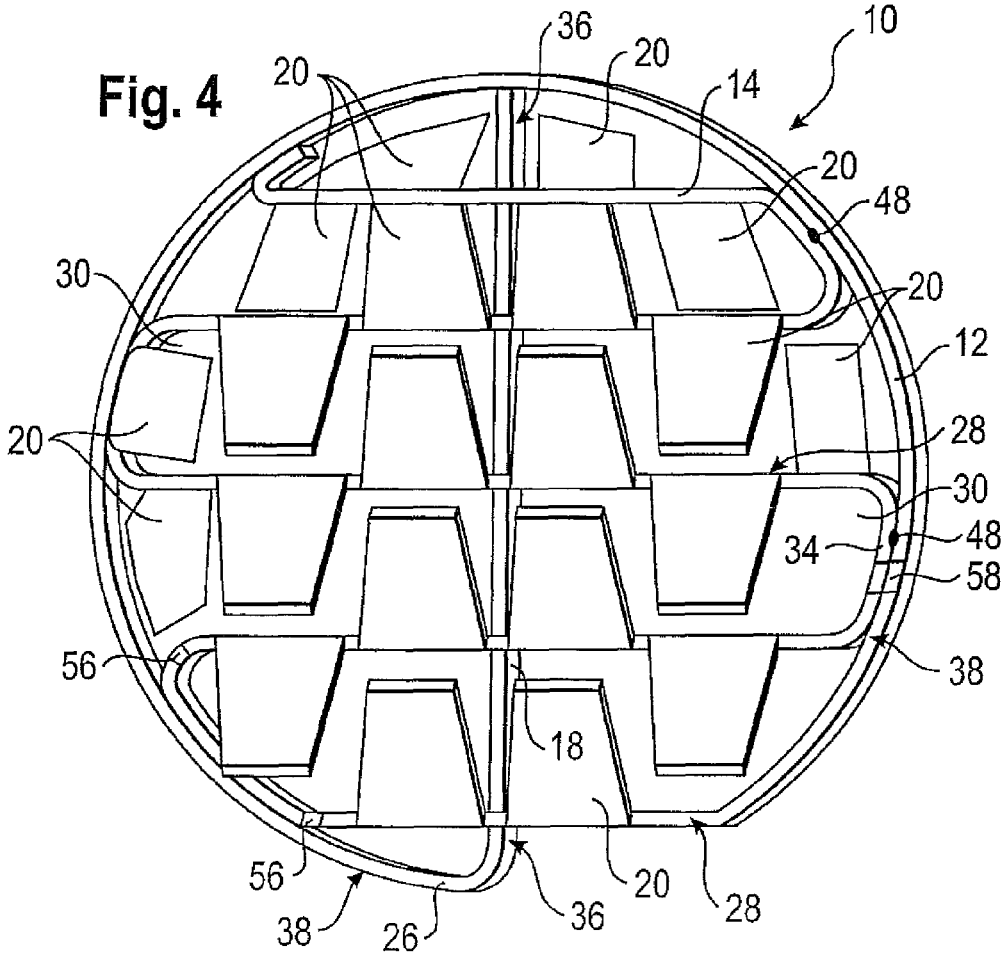
FIG. 4 shows a perspective view of a mixing element according to a second embodiment of the invention.

FIG. 4 shows a mixing element 10 according to a second embodiment of the invention, with identical or functionally identical components being denoted by the same reference numerals below and only the differences from the previously described first embodiment being discussed. In the mixing element 10 of FIG. 4, the frame 12 does not completely surround the grid-like component 14, and the deflector elements 20 are configured and arranged less regularly. In particular, the deflector elements 20 point in different directions with respect to the principal plane of the component 14, and some are not trapezoidal. In addition, the third section 38, which forms the frame 12, forms the central section of the metal strip 26, whereas the first section 28, which forms the loops 30, and the second section 36, which forms the second web 18, are edge sections. During production, preferably the first section 28 is first bent to form the loops 30, then the frame 12 is bent, and in the last step the second section 36 is bent over and fitted onto the loops 30.

In addition, the metal strip 26 includes a plurality of bending marks 56 in the form of recesses. The metal strip 26 was provided with these marks prior to the bending process. The bending marks 56 are utilized as points of orientation during bending and constitute a kind of predetermined buckling points. A further recess 58 which is provided both in the first section 28 and in the third section 38 serves to position the inner layer formed by the bent portion 34 relative to the frame 12.

Figure 5:
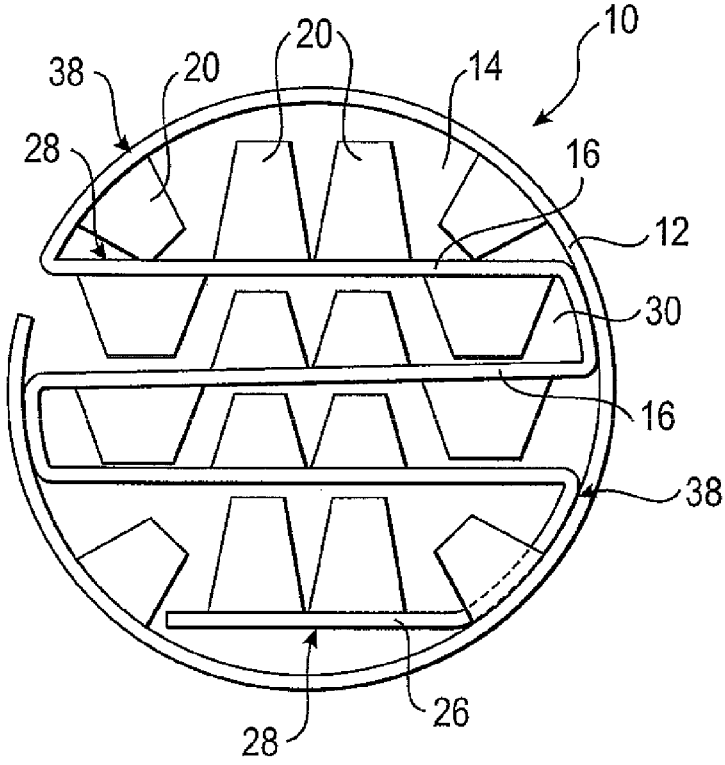
FIG. 5 shows a top view of a mixing element according to a third embodiment of the invention.

FIG. 5 shows a third embodiment of the mixing element 10 according to the invention, which differs from the configuration according to FIG. 1 essentially in that the second web 18 (and thus also the second section 36 of the metal strip 26) has been eliminated. Furthermore, additional deflector elements 20 pointing inwards are provided in the third section 38 forming the frame 12.

Figure 6:
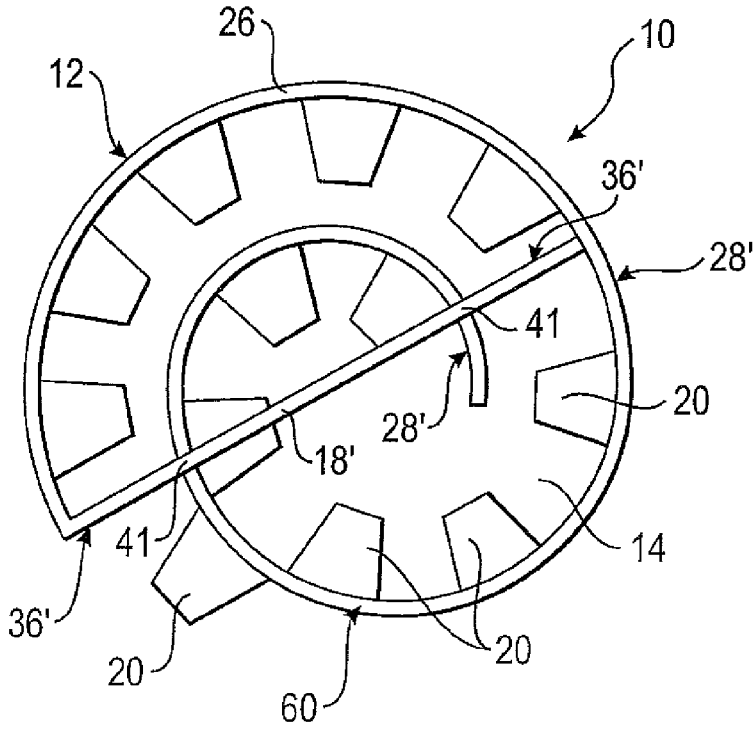
FIG. 6 shows a top view of a mixing element according to a fourth embodiment of the invention.

FIG. 6 shows a fourth embodiment of the mixing element 10 according to the invention, which differs from the mixing elements described so far in that the metal strip 26 includes a first section 28' which is bent to form a spiral 60. Here, the spiral 60 forms at the same time a part of the grid-like component 14 and a frame 12 partially surrounding the grid-like component 14. A second section 36' of the metal strip 26 is bent to form a web 18' intersecting the spiral 60. Again, the second section 36' includes a plurality of slits which are fitted into corresponding slits of the first section 28' to form points of intersection 41 of the grid-like component 14. In this example, the deflector elements 20 are arranged in the region of the first section 28' such that they form a spiral and most of them point inwards with respect to the metal strip 26. As an alternative, the radially inner part of the grid-like component could also be designed as an open or closed ring which has an extension pointing radially outwards towards the frame 12.

When the mixing element 10 is produced, the first section 28' is first bent to form the spiral 60, thereafter the second section 36' is bent over to form the web 18' and fitted onto the spiral 60. Subsequently, the deflector elements 20 are inclined with respect to the grid plane normal. In this embodiment, a welding or soldering of the grid-like component 14 is required at most in the region of the points of intersection 41.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A static mixing element, in particular for arrangement in an exhaust system of an internal combustion engine, comprising:

a grid component having a flow therethrough, the grid component comprising a plurality of intersecting webs and a frame at least partially surrounding an outer periphery of the webs; and a plurality of deflector elements which project from the grid component and are inclined in relation to a grid plane normal, wherein the plurality of intersecting webs, the frame, and the plurality of deflector elements are formed in one piece from an elongated metal strip.

2. The mixing element according to claim 1, wherein the grid component is formed by bending.

3. The mixing element according to claim 1, wherein the elongated metal strip includes a first section which is bent to form a plurality of substantially parallel loops.

4. The mixing element according to claim 3, wherein the plurality of intersecting webs includes at least a plurality of first webs and one or a plurality of second webs, and wherein partial portions, substantially parallel to each other, of the loops form the plurality of first webs of the grid component.

5. The mixing element according to claim 3, wherein the loops are open and U-shaped.

6. The mixing element according to claim 4, wherein the elongated metal strip includes a second section which forms one or the plurality of second webs intersecting the first webs of the grid component.

7. The mixing element according to claim 1, wherein the elongated metal strip includes a third section which forms the frame.

8. The mixing element according to claim 3, wherein the loops include bent portions that rest against the frame.

9. The mixing element according to claim 1, wherein the elongated metal strip is formed from a single strip that includes a first section bent to form a plurality of loops, a second section that forms one or more of the webs, and a third section that forms the frame that at least partially surrounds the grid component, and wherein the first section is a middle section and the second and third sections are edge sections of the metal strip.

10. The mixing element according to claim 1, wherein the elongated metal strip is formed from a single strip that includes a first section bent to form a plurality of loops, a second section that forms one or more of the webs, and a third section that forms the frame that at least partially surrounds the grid component, and wherein the third section is a middle section and the first and second sections are edge sections of the metal strip.

11. The mixing element according to claim 1, wherein the elongated metal strip includes a first section which is bent to form a spiral or a ring.

12. The mixing element according to claim 11, wherein the elongated metal strip includes a second section which is bent to form a web intersecting the spiral or the ring.

13. The mixing element according to claim 1, wherein the elongated strip is formed from a single strip that includes at least a first section and a second section, and wherein the second section includes a plurality of slits fitted into corresponding slits of the first section to form points of intersection.

14. A static mixing element, in particular for arrangement in an exhaust system of an internal combustion engine, comprising:

a grid component having a flow therethrough, wherein the grid component is formed in one piece from an elongated metal strip; and a plurality of deflector elements which project from the grid component and are inclined in relation to a grid plane normal, and wherein the deflector elements are arranged in a plurality of rows that are parallel to each other, with all of the deflector elements of one row being inclined in the same direction.

15. The mixing element according to claim 14, wherein the deflector elements of at least two directly adjacent middle rows are inclined in the same direction.

16. The mixing element according to claim 15, wherein the deflector elements of the rows that are adjacent to the middle rows are inclined in the opposite direction to those of the middle rows.

17. The first method step, providing an elongated metal strip including a plurality of deflector elements formed in one piece with the elongated metal strip, wherein the plurality of deflector elements project from a grid component and are inclined in relation to a grid plane normal.

18. The method according to claim 17, wherein the plurality of intersecting webs includes at least a plurality of first webs and at least one second web arranged perpendicularly thereto, and including the steps of bending a first section of the metal strip to form a plurality of substantially parallel loops, the parallel partial portions of which form the first webs;

bending a second section of the elongated metal strip to form the second web; and fitting the second web onto the first webs.

19. The method according to claim 17, including:

bending a first section of the elongated metal strip to form a spiral or a ring;

bending a second section of the elongated metal strip to form a web intersecting the spiral or the ring; and fitting the web onto the spiral or ring.

20. The method according to claim 17, including bending a section of the elongated metal strip to form the frame.

21. The method according to claim 20, including welding or soldering at least one of the webs to the frame at some points.

22. The method according to claim 17, including integrally forming the plurality of deflector elements with the elongated metal strip, with the plurality of deflector elements being inclined with respect to a grid plane normal.

23. The method according to claim 22, including using the deflector elements for locating during the bending process.

24. The method according to claim 17, including providing the elongated metal strip with bending marks prior to bending.

25. The mixing element according to claim 1, wherein the elongated strip is formed from a single strip that includes a first section bent to form a plurality of loops, a second section bent to intersect the loops, and a third section bent to form the frame.

26. The method according to claim 17, wherein the elongated strip comprises a single strip, and including bending a first section to form a plurality of loops, bending a second section to intersect the loops, and bending a third section to form the frame.

* * * * *